United States Patent [19]

Shin-Chin

[11] Patent Number: 4,838,151

[45] Date of Patent: Jun. 13, 1989

[54] COMBINATION WINDOW AND FLOOR FAN

[75] Inventor: Shao Shin-Chin, San-Chung, Taiwan

[73] Assignee: Holmes Products Corp., Holliston, Mass.

[21] Appl. No.: 148,838

[22] Filed: Jan. 27, 1988

[51] Int. Cl.[4] ..... F24F 7/013

[52] U.S. Cl. ..... 98/94.1

[58] Field of Search ..... 98/94.1, 94.2, 99.7

[56] References Cited

U.S. PATENT DOCUMENTS

| | | | |
|---|---|---|---|
| 1,153,067 | 9/1915 | Hackney . | |
| 1,752,372 | 4/1930 | Bothezat . | |
| 2,541,233 | 2/1951 | Fukai | 98/94.1 |
| 2,547,189 | 4/1951 | Welch, Sr. | 98/94.1 |
| 2,580,663 | 1/1952 | Delf et al. | 98/94.1 |
| 2,619,023 | 11/1952 | Kisling | 98/94.1 |
| 2,620,721 | 12/1952 | Krauss | 98/94.1 |
| 2,633,293 | 3/1953 | Jones . | |
| 2,650,535 | 9/1953 | Hord | 98/94.1 |
| 2,715,495 | 8/1955 | Sebastian | 98/94.1 X |
| 2,753,787 | 7/1956 | Heiman | 98/94.1 |
| 2,846,936 | 8/1958 | Copeland | 98/94.1 |
| 2,857,095 | 10/1958 | Svarez Grav | 98/94.1 X |
| 2,862,435 | 12/1958 | Buchenberger et al. | 98/94.2 |
| 3,019,718 | 2/1962 | MacLeod et al. | 98/99.7 X |
| 3,587,441 | 6/1971 | Woods | 98/94.2 |
| 3,861,283 | 1/1975 | Shaner | 98/94.2 |
| 4,341,151 | 7/1982 | Sakamoto | 98/94.1 |

FOREIGN PATENT DOCUMENTS

| | | | |
|---|---|---|---|
| 235520 | 9/1961 | Australia | 98/99.7 |

*Primary Examiner*—Harold Joyce

*Attorney, Agent, or Firm*—Irving M. Kriegsman

[57] ABSTRACT

A fan which can be mounted in a window opening without using any tools, mounting hardware or special brackets or used as a floor fan includes a pair of panel sections which are interconnected by a pair of hinge joints for pivotal movement relative to each other from a fully open position to a folded position. One of the hinge joints includes a mechanism for automatically snap-locking the two panel sections when they are at the fully open position at an angle of about 120 degrees. A pair of adjustable and lockable side extensions are provided, one attached to and extending out from each panel section. A fan unit which includes a motor driven fan is pivotally attached to the panel sections for rotational movement relative thereto.

27 Claims, 6 Drawing Sheets

FIG 2
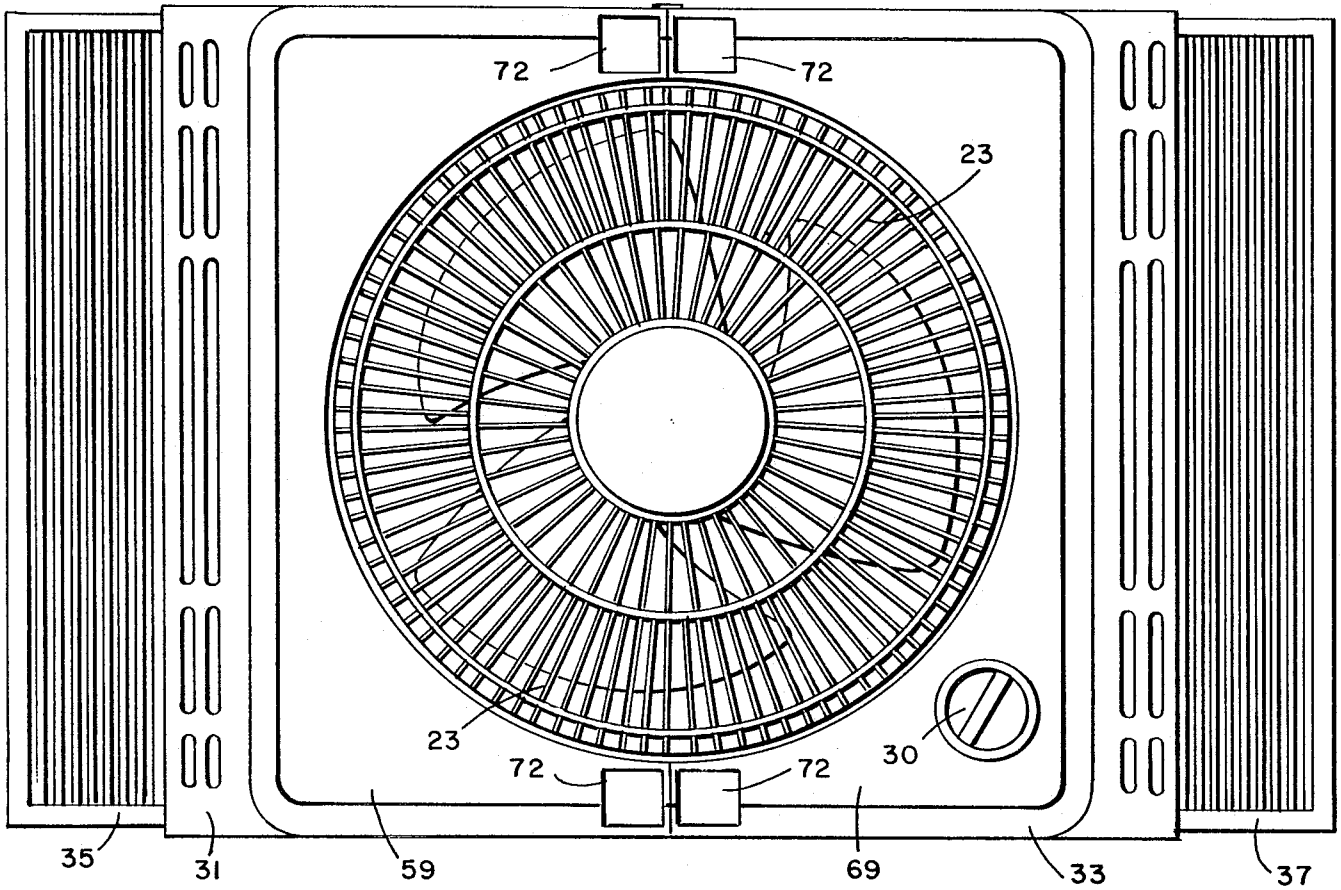
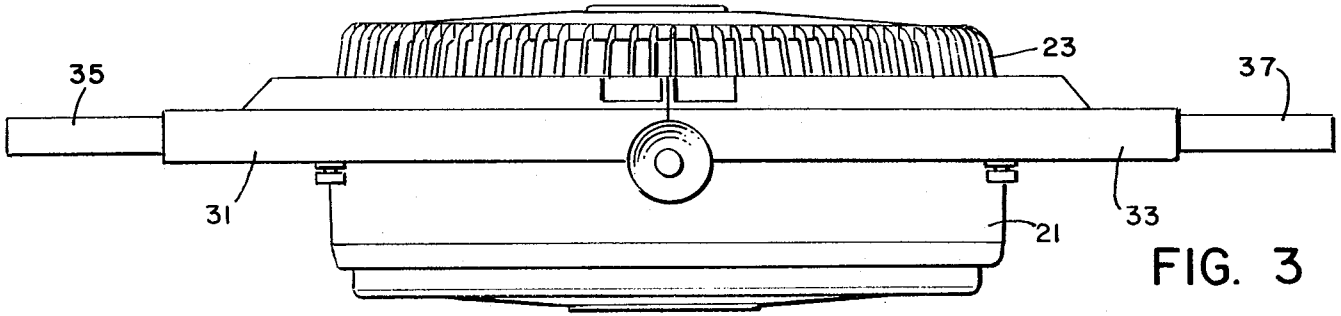
FIG. 3

COMBINATION WINDOW AND FLOOR FAN

BACKGROUND OF THE INVENTION

The present invention relates generally to a combination window and floor fan and more particularly to a combination window and floor fan which can be easily, removably and securely mounted in a window opening without having to use using any tools, special brackets or attaching hardware.

Fans which can be used either as a floor fan or as a window fan are well known in the art.

One common type of fan which is constructed so that it can either be set on a floor or mounted in a window opening comprises a generally rectangularly shaped frame and a fan unit. The frame includes a generally rectangular center section and a pair of adjustable side extensions, with one side extension being mounted on each side of the center section. A pair of brackets which serve as supporting feet when the fan is being used as a floor fan are pivotally mounted on the bottom of the center section. The fan unit includes a motor driven fan and is fixedly mounted in an opening formed in the center of the center section. When being used as a floor fan, the supporting feet are pivoted to a position which provides maximum support for the fan. When being used as a window fan, the side extensions are pulled out and brought into contact with the sides of the window frame in the window opening where the fan is being mounted. The fan is held in place in the window opening by closing the window on it so that it becomes wedged between the window sill and the bottom of the window and/or by fixedly attaching the side extensions to the sides of the window frame by mounting screws which are screwed into the sides of the window frame through mounting holes formed in the sides of the side extensions.

In U.S. Pat. No. 4,222,318 there is disclosed a fan which can be used either as a floor fan or a window fan and which includes an open frame having a motor driven fan connected to the rear portion thereof, a pair of protruding pins on the frame front portion which engage the window on the outside thereof, and a second pair of protruding pins on the frame front portion which engage the window frame on the inside thereof. The motor driven fan is suspended in this manner inwardly away from the window opening such that the cantilever effect produced thereby pulls the first pins inwardly against he window and pushed the second pins outwardly against the window frame. The frame of the fan diverges slightly in the vertical direction so that it is, in effect, wedged into the window opening and makes it more difficult to remove accidentally and strengthens the frame. The unit is easily adapted for use with a horizonally sliding window by attaching a pair of removable laterally extending brackets.

In U.S. Pat. No. 2,857,095 there is disclosed an all-purpose fan embodying in combination an air flow generating unit comprising a motor with coaxial shaft and rotary air impeller, a skeletonized framework united with an supporting said unit, an outer bail straddling said framework and pivotally connected thereto to swing about an axis of tilt disposed crosswise the axis of rotation of said air impeller, a swingable inner bail also straddling said framework and pivotally connected thereto and also pivotally connected to said outer bail in a manner to be swingable toward and away from planar, alignment therewith, detent devices operatively relating one of said bails to said framework in a manner releasably to retain the same in various relative angular positions to which said bail and framework may be swung, stop means so operatively relating said bails as to limit the degree of divergence thereof from said approximately planar alignment, and at least one hinge lug fixed on a portion of said outer bail relatively remote from said framework and having means of pivotal mounting offset from said outer bail.

In U.S. Pat. No. 2,733,002 there is disclosed a fan structure having a pair of fan units which can either be mounted in an opening in a window in vertical tandem relationship mounted or in horizontal tandem relationship or used separately as floor fans. When mounted in a window opening with the fan units in horizontal tandem relationship the fan is secured in position by clamping engagement of the fan housing with the lower edge of the window and the window sill. When mounted in vertical tandem relationship, the fan is secured in position by brackets which are screwed into the window frame.

In U.S. Pat. No. 2,529,040 there is disclosed a fan which is adapted to be mounted within the space normally occupied by the lower sash of an ordinary two sash window. The fan includes a rigid rectangular frame which is fixed in size and shape. In use, the frame is seated on the sill of the window and then anchored to the casing of the window by a pair of tie rods, the tie rods being hooked on to the frame of the fan and being secured by screws to the casing of the window.

Accordingly, it is an object of this invention to provide a new and improved fan.

It is another object of this invention to provide a fan which can be used either as a window mounted fan or as a floor fan.

It is still another object of this invention to provide a fan which can be securely and removably mounted in a window opening without having to use any tools, special brackets or mounting hardware.

It is yet still another object of this invention to provide a fan which can be either set on a floor or mounted in a window opening and wherein the direction of the air stream generated by the fan can be easily varied.

It is a further object of this invention to provide a fan which can be mounted securely in window openings varing considerably in width.

It is still a further object of this invention to provide a new and novel method of installing a window fan in a window opening.

It is another object of this invention to provide a new and novel frame construction for a window fan.

SUMMARY OF THE INVENTION

A fan which can either be set in a standing position on a floor or other horizontal planar surface and be self supporting or be easily, securely and removably mounted into a window opening without the use of tools, additional hardware or mounting brackets constructed according to the teachings of the present invention comprises a frame and a fan unit. The frame includes a pair of panel sections which are hingedly attached to each other in end-to-end relationship and a pair of adjustable side extensions, one attached to and extending out from each panel section. Means are provided for locking the two panel sections together at a fully open position, i.e. a position in which the two panel sections are 180 degrees apart. Means are also provided for selectively locking each side extension at a desired adjustment relative to its respective panel section. The fan unit is pivotally attached to the frame for rotational movement relative to the frame and includes an electric motor and a set of fan blades.

When the fan is to be used as a floor fan, the two panel sections are pivoted to a partially folded position so as to form a stand that is self-supporting and the fan unit is rotated to any desired angular position.

When the fan is to be mounted in a window opening, the two panel sections are first set at 180 degrees apart. The side extensions are then adjusted so that the overall width of the frame, i.e. the distance from the outer edge of one side extension to the outer edge of the other side extension, is just slightly (i.e. about ⅛ to ¼ of an inch) greater than the distance between the two sides of the window frame in which the fan is to be mounted and then locked in place relative to their respective panel sections at their respective adjustments. The panel sections are then partially folded relative to each other to any angle of less than 180 degrees (i.e. 160 degrees, 150 degrees, 140 degrees, etc.). The fan is then inserted into the window opening with the panel sections partially folded. Since the panel sections are partially folded, the overall width of the frame is less than the window opening width. As a result, the fan easily fits into the window opening between the two sides of the window frame. Once in place in the window opening, the two panel sections are straightened out and locked in place at 180 degrees. Since the fan width is slightly greater than the window opening width, the ends of the side extensions press tightly up against the sides of the window frame with the pressure of the side extensions against the sides of the window frame firmly securing the fan in place in the window opening. The fan unit is then turned to any desired angular position. The fan can be easily removed from the window opening by simply releasing the locking mechanism holding the two panel sections at 180 degrees, pivoting the panel sections relative to each other to form an angle of less than 180 degrees so that the side extensions are not being pushed against the sides of the window frame and then lifting the fan out from the window opening. As can be appreciated, no tools, hardware or brackets are needed in either installing or removing the fan from the window opening.

Various features and advantages will appear from the description to follow. In the description, reference is made to the accompanying drawing which forms a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts:

FIG. 2 is a front elevation view of the fan shown in FIG. 1 but with the two panel sections at 180 degrees apart;

FIG. 3 is a top view of the fan shown in FIG. 2;

FIG. 8(*b*) is an exploded perspective view of the upper hinge joint in the fan shown in FIG. 1;

DETAILED DESCRIPTION OF PREFERRED EMBODIMENTS

Figure 1:
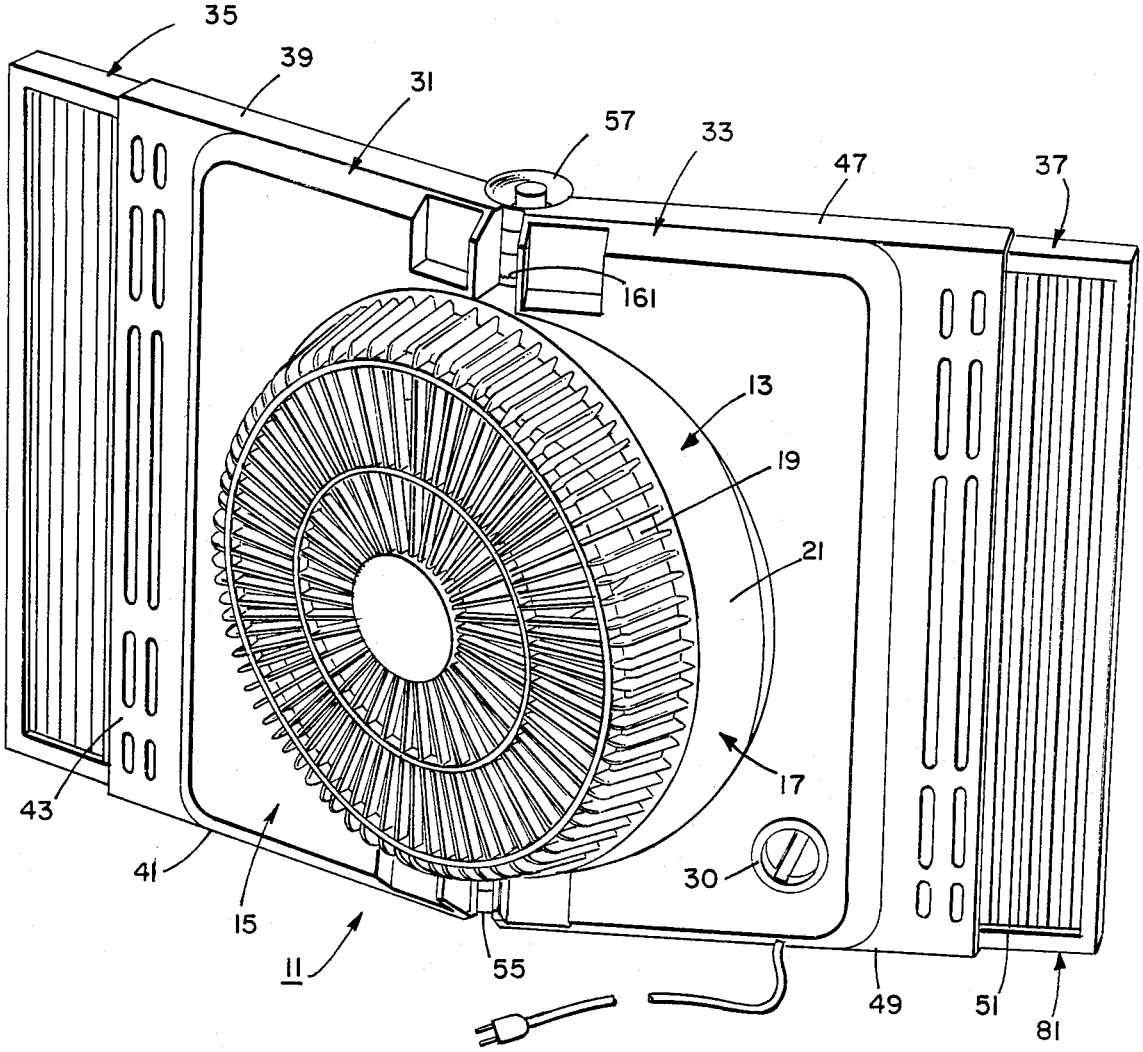
FIG. 1 is a perspective view of a fan constructed according to the teachings of the present invention with the two panel sections being pivoted to an angle of about 160 degrees.
Figure 5:
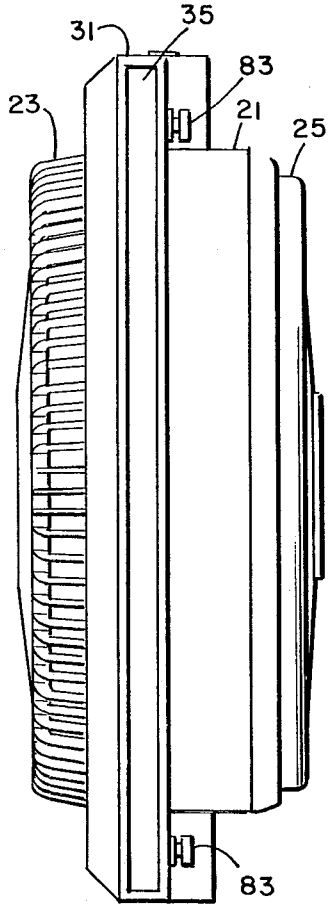
FIG. 5 is a right side view of the fan shown in FIG. 2.
Figure 4:
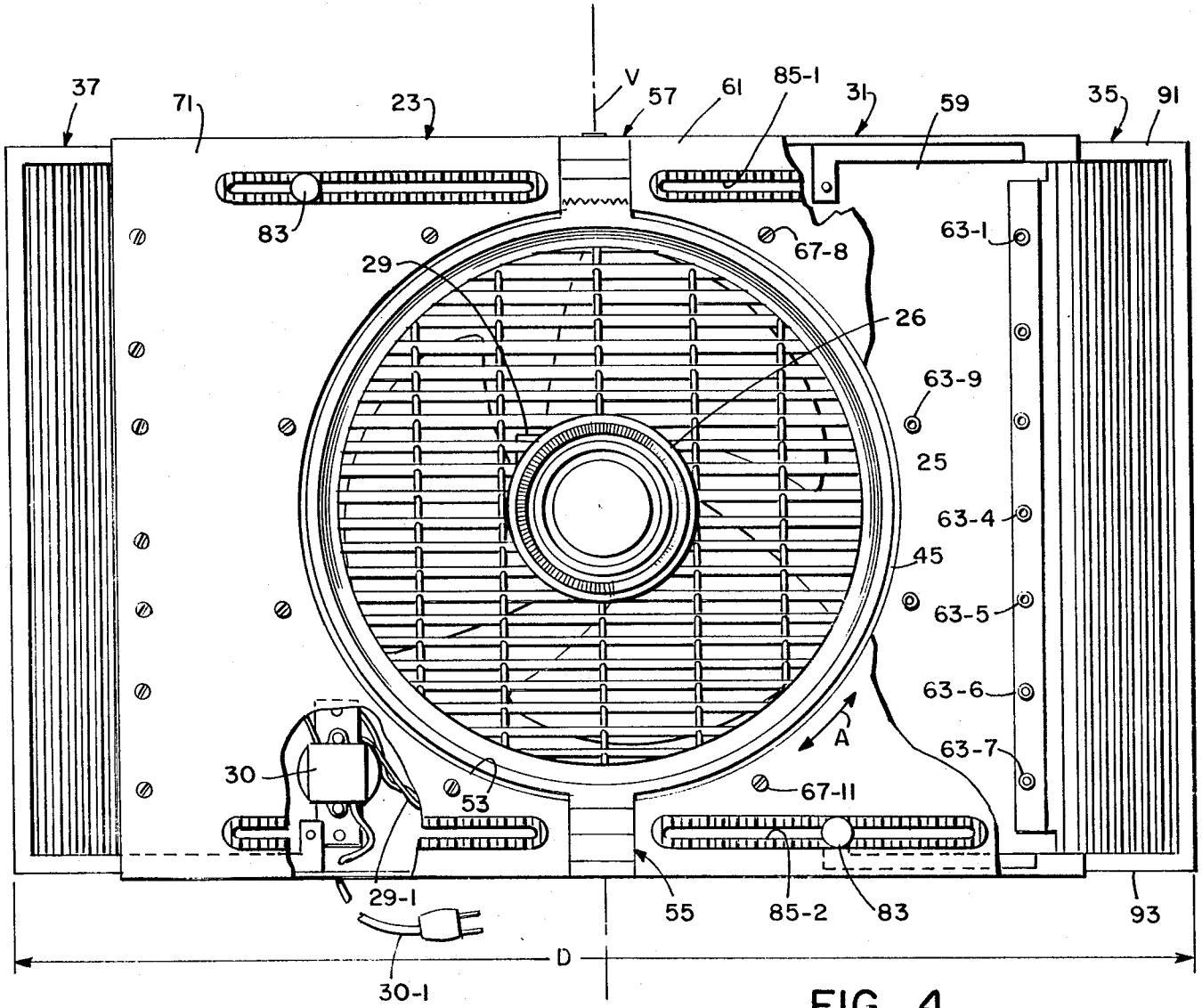
FIG. 4 is a back view partly broken away of the fan shown in FIG. 2.

It should be noted and will become readily apparent that the fan of the present invention when being mounted in a window opening is intended for use only with double-hung (vertical sash) type windows.

Referring now to the drawings, and first to FIGS. 1 through 5, there is shown a fan constructed according to the teachings of the present invention and identified generally by reference numeral 11.

For simplicity, parts of fan 11 not pertinent to the invention will not be shown or discussed.

Fan 11 comprises a fan unit 13 and a frame 15.

Fan unit 13 which serves to generate a stream of air comprises a compartment 17 and a fan assembly 19, fan assembly 19 being located inside compartment 27. Compartment 17 is generally cylindrically shaped and includes a generally circular rim 21, a grille 23 on one side of rim 21 and a louver grille 25 on the other side of rim 21. Grille 23 is fixedly secured to rim 21 by screws (not shown), while grille 25 is movably mounted on a disc 26 for rotation as shown by arrows A. Rim 21 and grilles 23 and 25 are made of a rigid plastic or other suitable material. Fan assembly 19 includes a set of fan blades 27 which are mounted on the shaft of an electric motor 29. Motor 29 is fixedly secured to rim 21 by a set of radially extending brackets (not shown) and disc 26 is integrally formed on motor 29. Motor 29 is attached by wires 29-1 to a switch 30. A cord 30-1 for connecting switch 30 to an electrical outlet is attached to switch 30.

Frame 15 which serves as a support for fan unit 13 includes left and right panels sections which are numbered 31 and 33, respectively. Each panel section 31, 33 is equipped with an adjustable side extension, the side extensions being numbered 35 and 37, respectively.

Panel section 31 includes a top edge 39 which is straight, a bottom edge 41 which is also straight and which is parallel to top edge 39, an outer edge 43 which is straight and perpendicular to top edge 39 and an inner edge 45 which has a curved portion. Panel section 33 includes a top edge 47 which is straight, a bottom edge 49 which is also straight and which is parallel to top edge 47, an outer edge 51 which is straight and perpendicular to top edge 47 and an inner edge 53 which has a curved portion.

Panel sections 31 and 33 are hingedly interconnected for pivotal movement relative to each other about a vertical axis V through lower and upper hinge joints 55 and 57. Hinge joints 55 and 57 also pivotally connect fan unit 13 to panel sections 31 and 33 for rotational movement relative to panel sections 31 and 33 about the same vertical axis V. Panel sections 31 and 33 can be pivoted relative to each other from a folded position where they are substantially parallel to a fully open position (FIGS. 2–5) where they are at an angle of 180 degrees. When panel sections 31 and 33 are 180 degrees apart, frame 15 has an overall generally rectangular shape with a circular opening, at the center. Fan unit 13 is pivotally attached to panel sections 31 and 33 such that it can be rotated a full 360 degrees.

Panel section 31 includes a compartment having a front enclosure 59 and a back plate 61. Enclosure 59 and plate 61 are fastened together by screws 63-11 which extend through mounting holes 65-1 through 65-11, respectively, formed in cover plate 61 and into internally threaded holes in bosses 67-1 through 67-11, respectively, formed on the inside of front enclosure 59. Panel section 33 includes a compartment having a front enclosure 69 and a back plate 71. Enclosure 69 and plate 71 are fastened together 63 in the same manner as panel section 31. Enclosure 59 and 69 and plates 61 and 71 are made of a rigid plastic or other suitable material. Enclosures 59 and 69 each include recessed areas 72 which are used for gripping or handling purposes.

Figure 6:
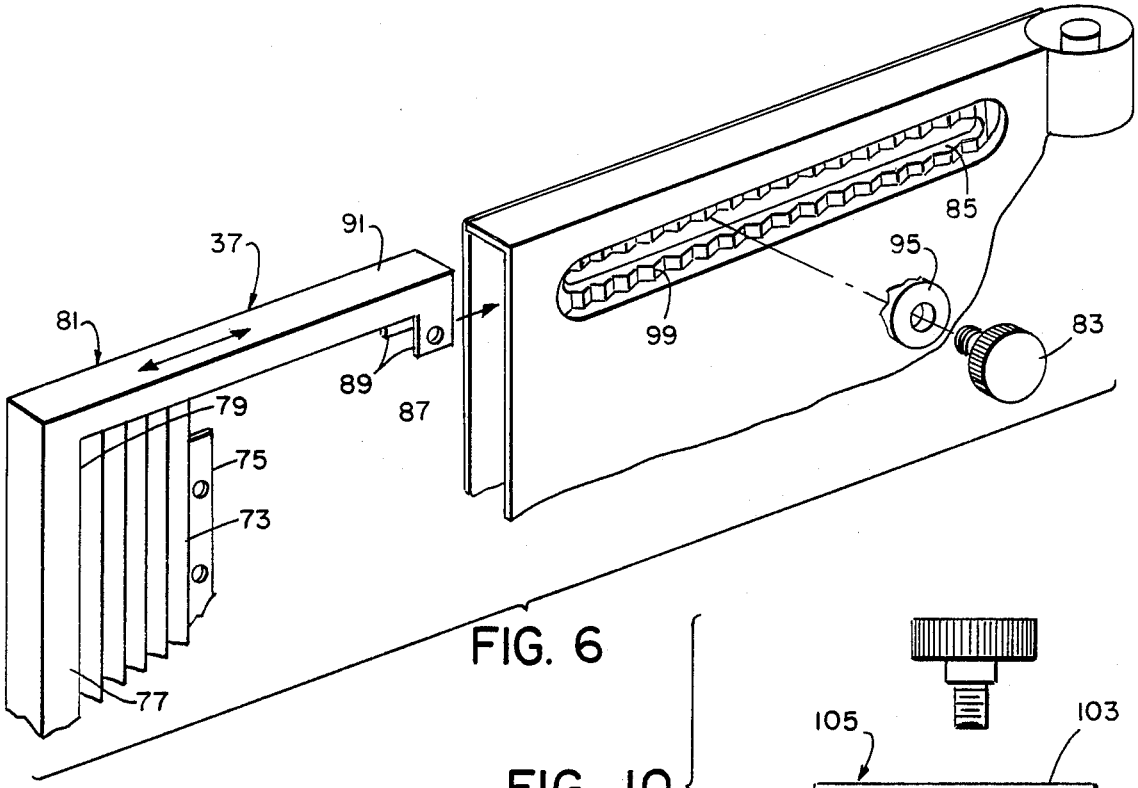
FIG. 6 is an exploded perspective view, partly broken away, of the right panel section of the fan shown in FIG. 1 along with its associated side extension and locking mechanism.
Figure 7:
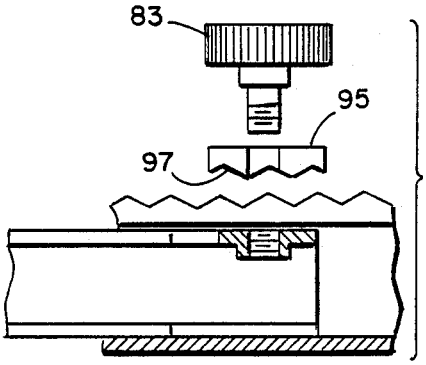
FIG. 7 is an exploded, fragmentary top section view of the locking arangement for the panel section and side extension shown in FIG. 8.

Side extension 37 (see also FIGS. 6 and 7) includes an expandable screen 73 which is made of a sheet of flexible plastic or other suitable material. Screen 73 is generally rectangular in shape and includes an inner end 75 and an outer end 77. Inner end 75 is mounted on bosses 67-1 through 67-7 of front enclosure 59. Outer end 77 is fixedly attached by suitable means (not shown) to the center leg 79 of a U shaped bracket 81 which is slidably mounted in panel section 31. In use outer end 77 screen 73 is pulled or pushed in to a desired position relative to panel section 31 and locked in place at that position by a pair of locking screws 83 which extend through upper and lower horizontal slots 85-1 and 85-2, respectively, formed in back plate 61 and into engagement with threaded holes 87 formed in tabs 89 at the ends of the end legs 91 and 93 of bracket 81. Each locking screw 83 includes a locking washer 95 whose roughened inner suface 97 engages a roughened outer surface 99 formed in slot 85.

Side extension 35 is identical to side extension 37 and is attached to panel section 33 in the same way as side extension 37 is attached to panel section 31 and used in the same way.

Figure 8B:
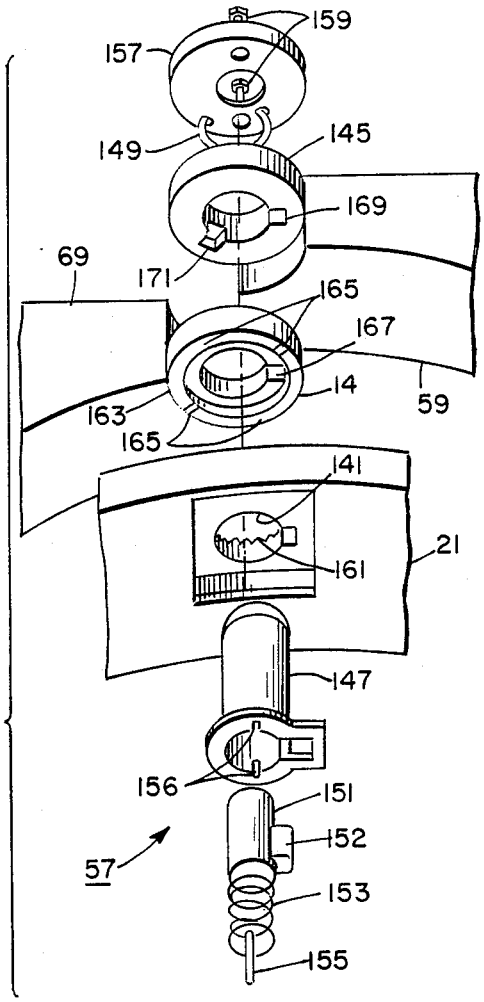
FIG. 8(*a*) is an exploded perspective view of the lower hinge joint in the fan shown in FIG. 1.
Figure 8A:
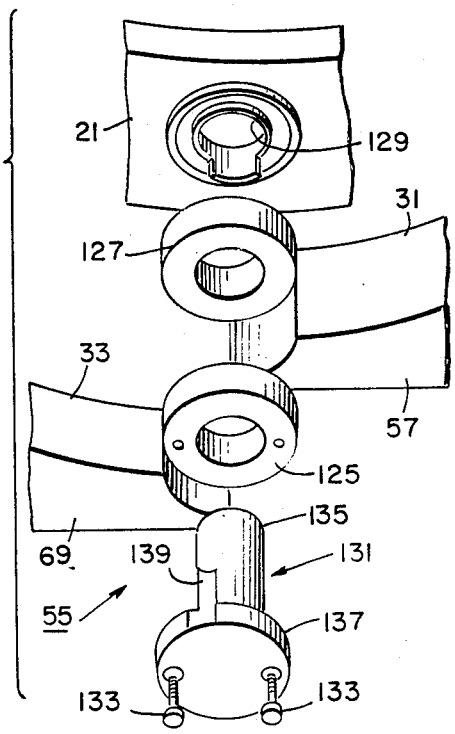

Referring now to FIGS. 8(*a*) and 8(*b*), there is shown exploded perspective views taken from the back of hinge joints 55 and 57, respectively.

Hinge joint 55 includes a lower hinge loop 125 which is integrally formed with front enclosure 69 of panel section 33, an upper hinge loop 127 which is integrally formed with front enclosure 59 of panel section 31 and a circular opening 129 formed at the bottom rim 21 of fan unit 13. A hinge post 131 extends up through the hinge loops 125 and 127 and through a circular opening 129 and is secured to hinge loop 125 by a pair of screws 133. Hinge post 131 includes a hollow shaft portion 135 and a base portion 137. An opening 139 is formed in the side of hinge post 131 so that wires 29-1 from fan motor 29 can be passed through to switch 30.

Figure 9:
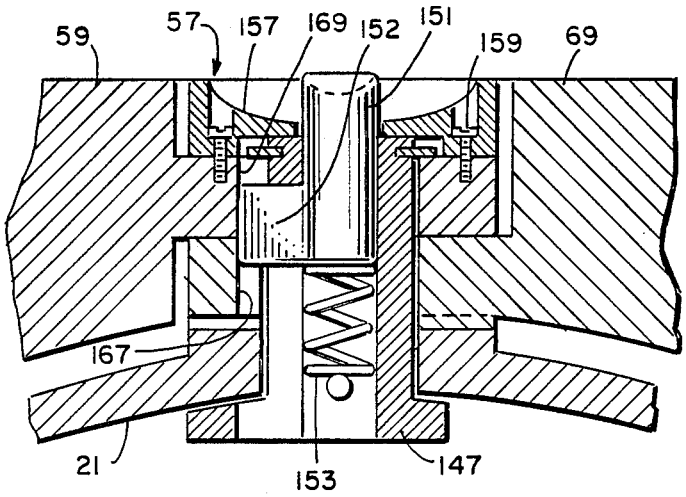
FIG. 9 is a front section view of the upper hinge joint in the fan shown in FIG. 1.

Hinge joint 57, which is also shown in section in FIG. 9, is a locking hinge which permits pivotal movement of panel section 31 relative to panel section 33 and also snap-locks the two panel sections together at two different angular positions, one at 180 degrees and the other at 120 degrees. Joint 57 includes a circular opening 141 formed at the top of rim 21, a lower hinge loop 147 which is integrally formed with front enclosure 69 and an upper hinge loop 145 which is integrally formed with front enclosure 59. A hollow locking post 147 extends up through opening 141, hinge loop 143 and hinge loop 145 and is held in place against downward movement by a split ring 149. A keyed button 151 is slidably mounted in post 147. Button 151 is pushed upward by a compression spring 153 which is held in place by a pin 155 which extends through a pair of holes 156 in post 147. A top cover 157 is attached to loop 145 by a pair of screws 159. The top surface of rim 21 around the periphery of opening 141 is roughened as shown by reference numeral 161 and the bottom surface 163 of hinge loop 143 is provided with raised portions 165 to frictionally engage rim 21 and hold it at a desired angular position relative to enclosure 69. Hinge loop 143 contains a single locking slot 167 and hinge loop 145 contains a pair of locking slots 169 and 171.

Hinge joint 57 operates in the following manner. Key 152 is always extending at least partially into slot 167, regardless of its axial position in post 147. When key 152 is also extending into either slot 169 such as shown in FIG. 9 or in slot 171 then enclosure 69 (of panel section 31) is locked relative to enclosure 59 (of panel section 31) and cannot pivot relative to enclosure 59. When key 152 is in slot 169 (as well as slot 167) the two enclosures are fixed at 180 degrees apart. When key 152 is in slot 171 (as well as slot 167) the two enclosures are fixed at 120 degrees apart. When key 152 is in slot 167 but but extending into either slot 169 or slot 171 then enclosures 59 and 69 are not locked against pivotal movement. Hinge joint 67 is unlocked (i.e. released) by pressing down on button 151 until key 152 is only in slot 167 and enclosure 59 is free to move relative to enclosure 69.

Figure 10:
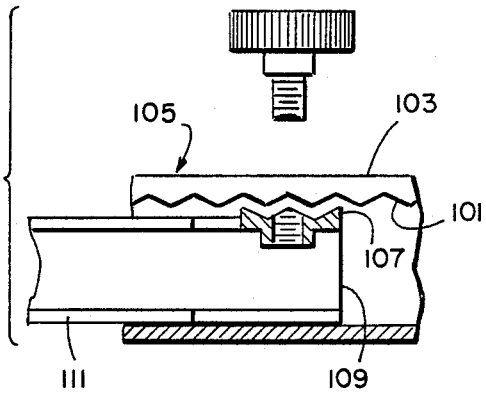
FIG. 10 is an exploded fragmentary top section view of a modification of the locking arrangement shown in FIG. 7.

In FIG. 10 there is shown another arrangement for locking the side extension at a particular adjustment within its panel section. In this arrangement the locking washer is eliminated. Instead, the inside surface 101 of the back plate 103 of the panel section 105 is roughened shaped to mate with a roughened outer surface 107 of the tab 109 at the end of the bracket 111.

Figure 11:
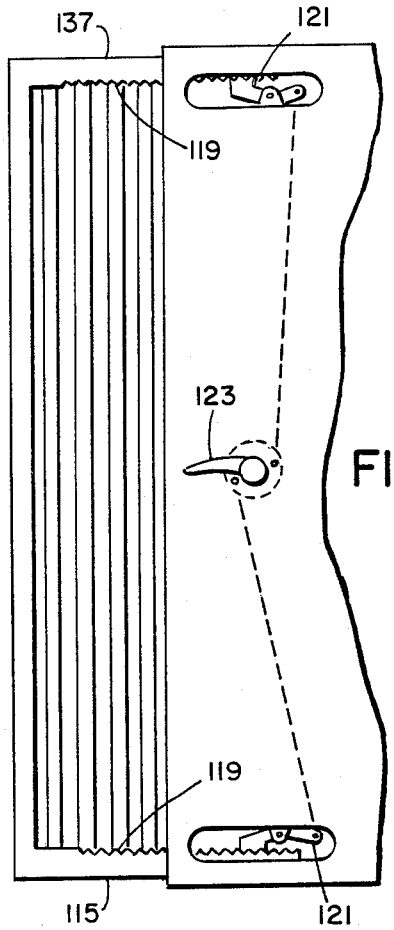
FIG. 11 is a fragmentary back view of another version of a panel section, its side extension and the locking mechanism.

In FIG. 11 there is shown still another arrangement for locking the side extension at a particular adjustment within its panel section. In this arrangement, legs 113 and 115 of U shaped bracket 117 are constructed to include teeth 119 which are gripped by hooks 121 mechanically attached to a lever 123.

Figure 12:
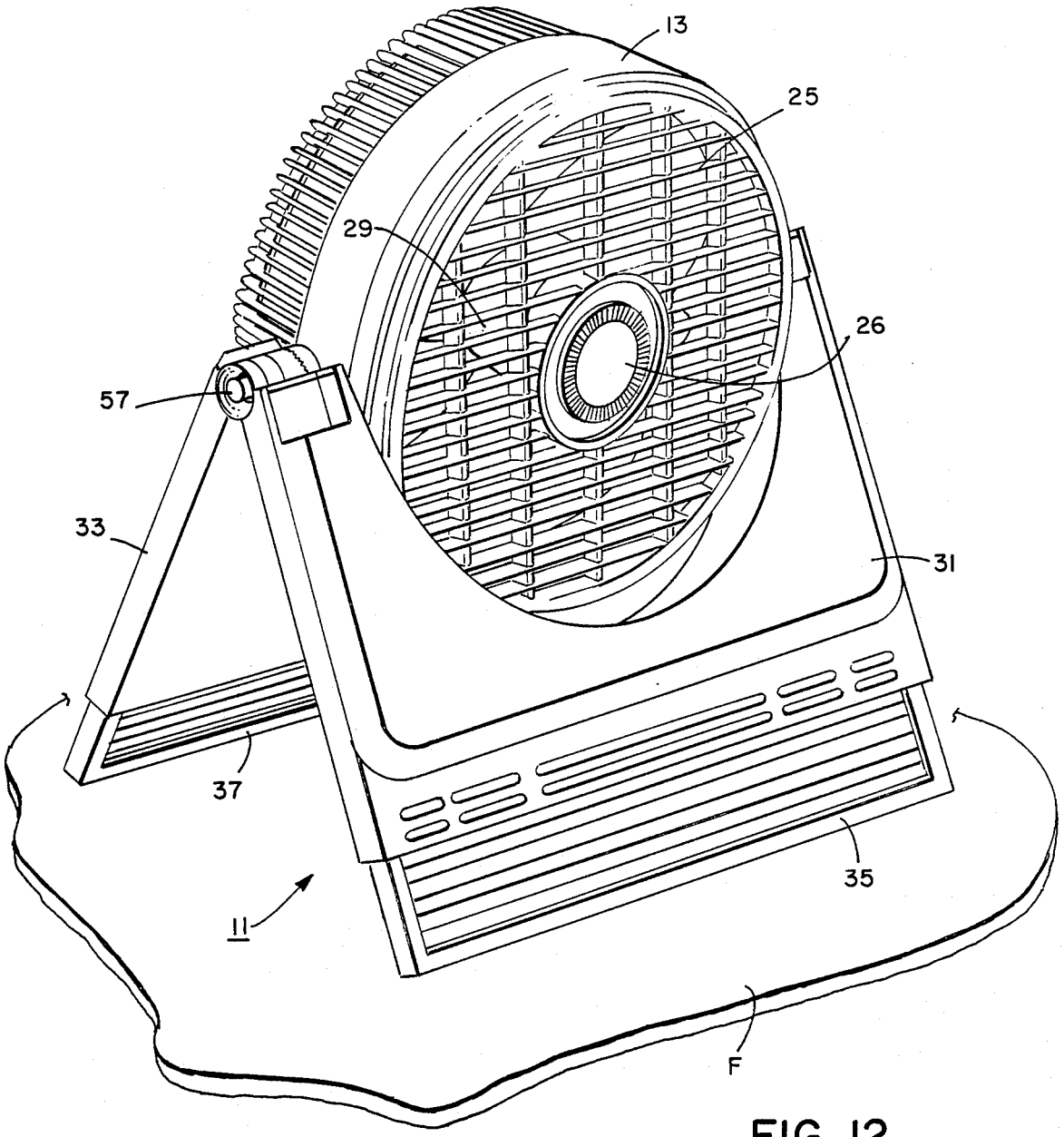
FIG. 12 is a perspective view showing how the fan of FIG. 1 is arranged for use as a floor fan.

Referring now to FIG. 12 there is shown a perspective view of fan 11 seated for use on a floor F. Panel sections 31 and 33 are locked in place at an angle of 120 degrees and side extensions 35 and 37 are locked in place at any desired adjustment. Fan unit 13 is set at any desired angular position relative to panel sectioins 31 and 33. If desired, instead of resting on the outer edges side extensions 35 and 37, fan 11 can be turned ninety degrees and set on either the top or the bottom edges of panel sections 31 and 33. In this case, panel sections 31 and 33 can be at any angular position between 0 and 180 degrees that will render the frame self-supporting and need not be locked. Side extensions 35 and 37 also need not be locked relative to their respective side panels.

Figure 13:
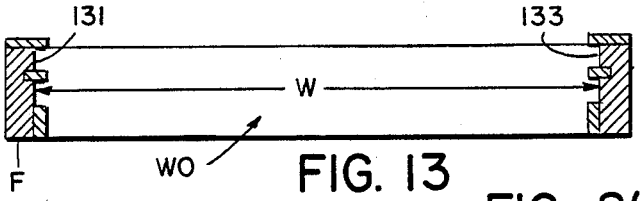
FIGS. 13 through 15 are a series of illustrations showing how the fan of FIG. 1 is mounted in a window opening.
Figure 14:
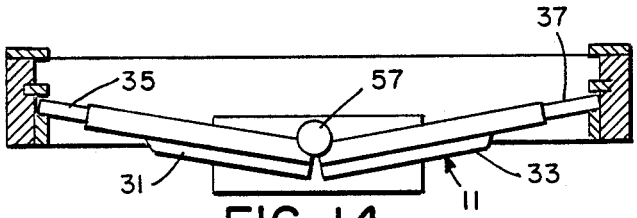
Figure 15:
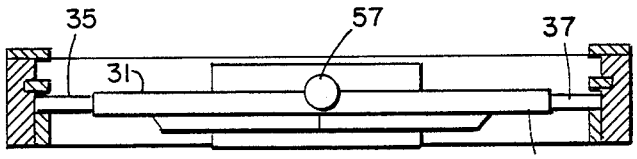

Referring now to FIGS. 13–15, there is shown a series of plan section views illustrating how fan 11 maybe mounted in a window opening WO. A plan view of the window opening WO, without fan 11 is shown in FIG. 13, the left side of the window frame F being designated by reference numeral 131 and the right side of the window frame F being designated by reference numeral 133.

First, the width W of the window opening in which the fan is to be mounted, i.e. the distance between sides 131 and 133, is measured. Then, panels 31 and 33 of fan 11 are pivoted to 180 degrees apart (i.e. fully open). Then, side extensions 35 and 37 are adjusted such that the distance D from the outer end of one side extension to the outer end of the other side extension (see FIG. 2) is very slightly greater (i.e. about $\frac{1}{8}$ to $\frac{1}{4}$ of an inch more) than width W and the side extensions locked in place at such adjustments. For example, if width W is 25 inches than distance D is set at $25\frac{1}{8}$ inches.

Then, panel sections 31 and 33 are pivoted to any partially folded position, i.e. any angular position less than 180 degrees, such as for example 155 degress. Then, with panel sections 31 and 33 so pivoted, fan 11 is placed in the window opening WO, as shown in FIG. 14. Since, panel sections 31 and 33 are pivoted to an angle less than 180 degrees, fan 11 will easily and loosely fit between sides 131 and 133 of frame F.

Finally, fan 11 is pushed from the center in the direction shown by arrow B, see FIG. 15, causing the panel sections 31 and 33 to straighten out to 180 degrees and snap lock in place at that angular position. Since distance D is very slightly greater than width W, the sides of side extensions 35 and 37 will press tightly up against sides 131 and 133 of frame F and thereby wedge fan 11 within the sides of frame F, the difference in measurements D and W being accommodated by the give in the window frame and/or the fan components. Fan unit 13 is then rotated to any desired position.

Fan 11 is removed from window opening WO by simply unlocking the locking mechanism or hinge joint 57 (by pushing down on button 151) and then pulling fan 11 back from the center as shown by arrow E. This will cause panel sections 31 and 33 to pivot to a position of less than 180 degress. Once so pivoted, fan 11 can be easily withdrawn.

As can be appreciated no tools, brackets or mounting hardware are needed for mounting fan 11 in the window opening and fan 11 is not limited to any particular window opening width.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A fan which can be either placed in a standing position on a planar surface such as a floor and be self supporting or mounted into a window opening and held securely in place without the use of additional hardware or mounting brackets comprising:

a. a fan unit, and b. a frame, said frame including:

i. a pair of panel sections, ii. a pair of adjustable side extensions, one mounted on each panel section, iii. means hingedly interconnecting said panel sections in end-to-end relationship for pivotal movement relative to each other about a vertical axis and pivotally attaching said fan unit to said frame for rotational movement relative to said frame, and iv. means for locking said panel sections at 180 degrees apart, v. means locking each side extension at a desired adjustment.

2. The fan of claim 1 and wherein said two panel sections are pivotally movable relative to each other from a folded position wherein said two panel sections are substantially parallel to a fully open position wherein said two panel sections are at an angle of 180 degrees.

3. The fan of claim 2 and wherein said fan unit is centrally located on said frame.

4. The fan of claim 3 and wherein said fan unit is attached to said frame for rotation about said vertical axis.

5. The fan of claim 4 and wherein said panel section locking means is constructed for also locking said pair of panel sections at a position between said fully open position and said folded position.

6. The fan of claim 4 and wherein said means for locking each one of said pair of side extensions at a desired adjustment includes a slot on the panel section, a hole on the side extension, a bolt and a locking washer.

7. The fan of claim 6 and wherein said means for hingedly interconnecting said panel sections in end-to-end relationship and pivotally attaching said fan unit to said frame comprises an upper hinge joint and a lower hinge joint and wherein each hinge joint includes a first hinge loop fixed to one of said panel sections, a second hinge loop fixed to the other one of said panel sections, an opening in said fan unit and a hinge post extending through said first hinge loop, said second hinge loop and said opening in said fan unit.

8. The fan of claim 7 and wherein each panel section includes a front wall and a back wall, said back wall being spaced from said front wall.

9. The fan of claim 8 and wherein each side extension includes an expandable screen and a frame for supporting said screen and wherein one end of said expandable screen is attached to its respective panel section.

10. The fan of claim 9 and wherein said fan unit comprises:

a. an annular shaped supporting rim, b. a motor mounted on the supporting rim, said motor having a drive shaft, and c. a set of fan blades mounted on said drive shaft.

11. The fan of claim 10 and wherein said panel sections are shaped to define a generally rectangularly shaped frame having a circular opening at the center when said panel sections are disposed 180 degrees apart.

12. The fan of claim 9 and wherein the side extension locking means includes teeth on said side extension frame and hooks on said panel sections.

13. The fan of claim 1 and wherein the means for locking the two panel sections at an angle of 180 degrees is automatic.

14. A fan comprising:

a. a frame, said frame comprising:

i. a pair of panel sections hingedly interconnected in end-to-end relationship and lockable at 180 degrees relative to each other, and ii. a pair of adjustable and lockable side extensions, one mounted on each panel section, and b. fan means mounted on said frame.

15. A method of installing a fan in a window opening, the window opening being defined by a window will, the bottom of a window and the sides of a window frame, the fan comprising a pair of hingedly interconnected panel sections lockable at 180 degrees apart, a pair of adjustable and lockable side extensions, one on each panel section and a fan unit, the method comprising:

a. adjusting said side extensions so that the distance from the outer end of one side extension to the outer end of the other side extension when the panel sections are at 180 degrees is slightly greater than the distance between the sides of the window frame and then locking said side extensions as so extended, b. inserting the fan in the window opening with the panel sections at less than 180 degrees, and c. straightening out said panel sections to 180 degrees and locking said panel sections at said 180 degree angle.

16. An electric fan comprising:

a. a pair of panel sections, b. a pair of adjustable side extensions, one attached to and extending out from each panel section, c. means hingedly interconnecting said panel sections in end-to-tend relationship for pivotal movement relative to each other, d. means for locking said panel sections at 180 degrees apart, e, means locking each side extension at a desired adjustment, and f. a fan unit mounted on said panel sections.

17. A combination window and floor fan comprising:

a. a pair of panel sections, b. an adjustable side extension attached to and extending out from one of said panel sections, c. means hingedly interconnecting said panel sections in end-to-end relationship for pivotal movement relative to each other, d. means for locking said panel sections at 180 degrees apart, e. means locking said side extension at a desired adjustment, and f. a fan unit attached to said panel sections.

18. A fan comprising:

a. a fan unit, b. a pair of panel sections, c. a pair of adjustable side extensions, one attached to and extending out from each panel section, d. means hingedly interconnecting said panel sections in end-to-end relationship for pivotal movement relative to each other from a folded position to a fully open position and pivotally attaching said fan unit to said panel sections, and e. panel section locking means for locking said panel sections at at least 180 degrees apart and f. side extension locking means for locking each side extension at a desired adjustment.

19. A fan comprising:

a. a fan unit, b. a pair of panel sections, c. a pair of adjustable side extensions, one mounted on and extending out from each panel section, d. upper and lower hinge joints for hingedly interconnecting said panel sections in end-to-end relationship for pivotal movement relative to each other about a vertical axis and pivotally attaching said fan unit to said panel sections for rotational movement relative thereto, one of said hinge joints including means for locking said panel sections at 180 degrees apart, and e. means locking each side extension at a desired adjustment.

20. The fan of claim 19 and wherein each hinge joint includes a first hinge loop fixed to one of said panel sections, a second hinged loop fixed to the other one of said panel sections, an opening in said fan unit and a post extending through both said first hinge loop and said second hinge loop and said opening in said fan unit.

21. The fan of claim 20 and wherein said panel section locking means in one of said hinge joints comprises a keyed button slidably mounted in said post and wherein each hinge loop in said hinge joint includes a locking slot.

22. The fan of claim 21 and wherein the outer end of each side extension is flat surface.

23. A fan comprising:

a. a fan unit, b. a pair of panel sections, c. a pair of adjustable side extensions, one mounted on and extending out from each panel section, d. means hingedly interconnecting said panel sections in end-to-end relationship for pivotal movement relative to each other about a vertical axis and pivotally attaching said fan unit to said frame for rotational movement relative to said panel sections, e. means for locking said panel sections at 180 degrees apart and a partly folded angular position, and f. means locking each side extension at a desired adjustment.

24. A fan comprising:

a. a fan unit, b. a pair of panel sections, c. a pair of adjustable side extensions, one mounted on each panel sections, d. means hingedly interconnecting said panel sections in end-to-end relationship for pivotal movement relative to each other about a vertical axis and pivotally attaching said fan unto said frame for rotational movement relative to said panel sections, and e. means for locking said panel sections at 180 degrees apart, and f. means locking each side extension at a desired adjustment.

25. An electric fan comprising:

a. a pair of panel sections, b. a pair of adjustable side extensions, one attached to and extending out from each panel section, means hingedly interconnecting said panel sections in end-to-end relationship for pivotal movement relative to each other, c. means for locking said panel sections at 180 degrees apart and a partly folded angular position, d. means locking each side extension at a desired adjustment, and e. a fan unit mounted on at least one of said panel sections.

26. The fan of claim 25 and wherein said partly folded angular position is about 120 degrees.

27. A combination window and floor fan comprising:

a. a pair of panel sections, b. means hingedly interconnecting said panel sections in end-to-end relationship for pivotal movement relative to each other, c. means for locking said panel sections at 180 degrees apart, d. a fan unit attached to one of said panel sections.

* * * * *